US008241481B2

(12) United States Patent
Kim et al.

(10) Patent No.: US 8,241,481 B2
(45) Date of Patent: Aug. 14, 2012

(54) MANUFACTURING METHOD OF 3D SHAPE STRUCTURE HAVING HYDROPHOBIC INNER SURFACE

(75) Inventors: Dong-Seob Kim, Pohang (KR); Dong-Hyun Kim, Seoul (KR); Woon-Bong Hwang, Pohang (KR); Hyun-Chul Park, Pohang (KR); Kun-Hong Lee, Pohang (KR); Geun-Bae Lim, Pohang (KR); Sang-Min Lee, Pohang (TW); Joon-Won Kim, Pohang (TW)

(73) Assignee: Postech Academy-Industry Foundation, Hyoja-Dong, Nam-Ku, Kyungsangbuk-Do, Pohang (KR)

( * ) Notice: Subject to any disclaimer, the term of this patent is extended or adjusted under 35 U.S.C. 154(b) by 445 days.

(21) Appl. No.: 12/452,873

(22) PCT Filed: Mar. 12, 2008

(86) PCT No.: PCT/KR2008/001398

§ 371 (c)(1),
(2), (4) Date: Jan. 26, 2010

(87) PCT Pub. No.: WO2009/017294

PCT Pub. Date: Feb. 5, 2009

(65) Prior Publication Data

US 2010/0126873 A1 May 27, 2010

(30) Foreign Application Priority Data

Aug. 1, 2007 (KR) ..... 10-2007-0077497

(51) Int. Cl.
*C23C 28/00* (2006.01)

(52) U.S. Cl. ..... 205/199; 205/198

(58) Field of Classification Search ..... 205/198, 205/199

See application file for complete search history.

(56) References Cited

U.S. PATENT DOCUMENTS

| | | | |
|---|---|---|---|
| 6,641,767 | B2 | 11/2003 | Zhang et al. |
| 2007/0148815 | A1 | 6/2007 | Chao et al. |

FOREIGN PATENT DOCUMENTS

| | | |
|---|---|---|
| JP | 63-143290 | 6/1988 |
| JP | 01-263035 | 10/1989 |
| JP | 02-254192 | 10/1990 |
| JP | 09-155972 | 6/1997 |
| JP | 10-096599 | 4/1998 |
| JP | 10-278277 | 10/1998 |
| KR | 10-2007-0007955 | 1/2007 |
| KR | 10-2007-0029762 | 3/2007 |
| WO | 2007/059586 | 5/2007 |

OTHER PUBLICATIONS

D. Kim, et al., "Superhydrophobic nanostructures based on porous alumina", Current Applied Physics, North-Holland, vol. 8, No. 6, Oct. 10, 2007, pp. 770-773.*

* cited by examiner

*Primary Examiner* — Luan Van
(74) *Attorney, Agent, or Firm* — Lexyoume IP Meister, PLLC

(57) ABSTRACT

The present invention relates to a manufacturing method of a three dimensional structure having a hydrophobic inner surface. The manufacturing method includes anodizing a three dimensional metal member and forming fine holes on an external surface of the metal member, forming a replica by coating a non-wetting polymer material on the outer surface of the metal member and forming the non-wetting polymer material to be a replication structure corresponding to the fine holes of the metal member, forming an exterior by surrounding the replication structure with an exterior forming material, and etching the metal member and eliminating the metal member from the replication structure and the exterior forming material.

11 Claims, 14 Drawing Sheets

【FIG. 1】
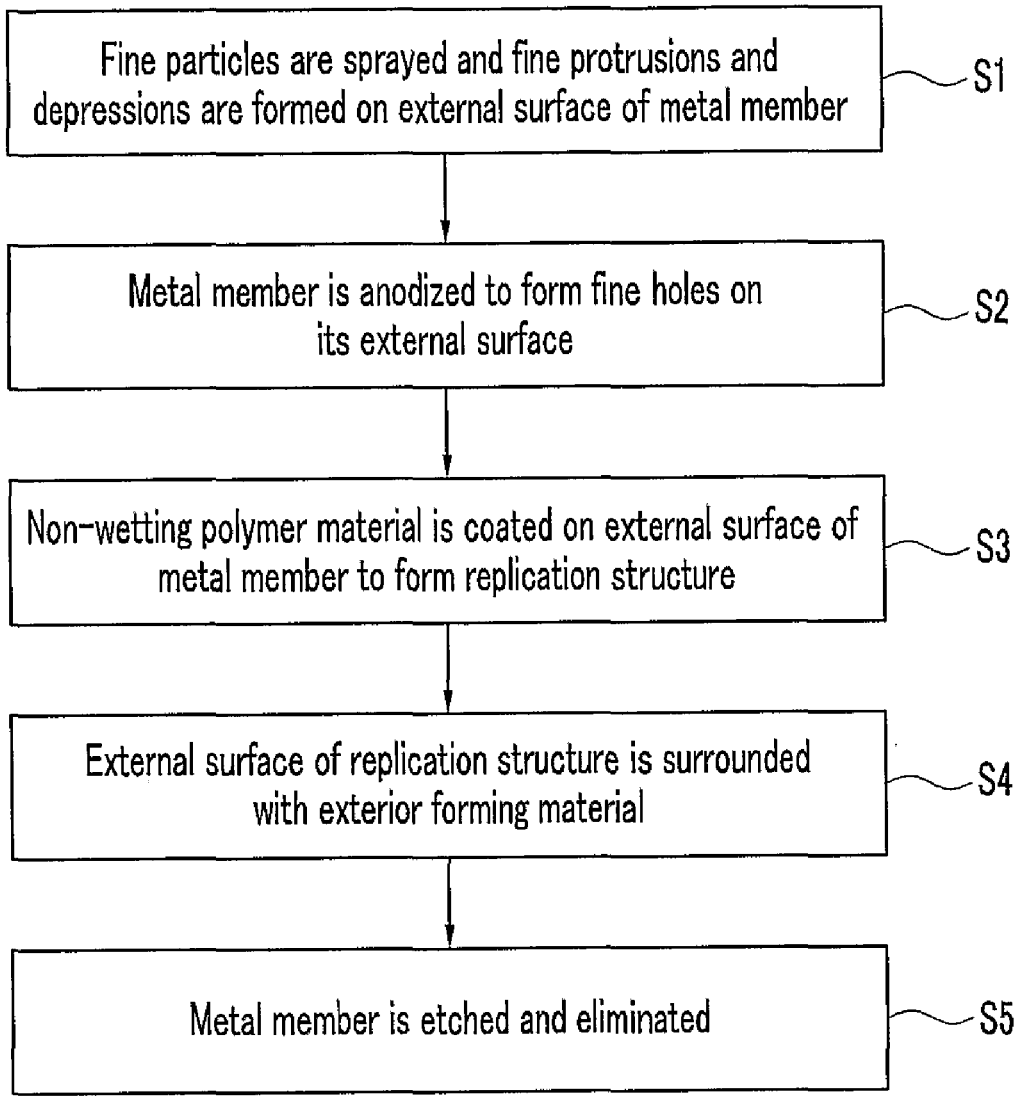

【FIG. 2a】
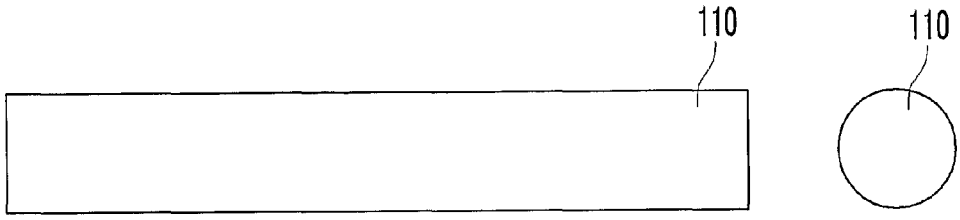
【FIG. 2b】
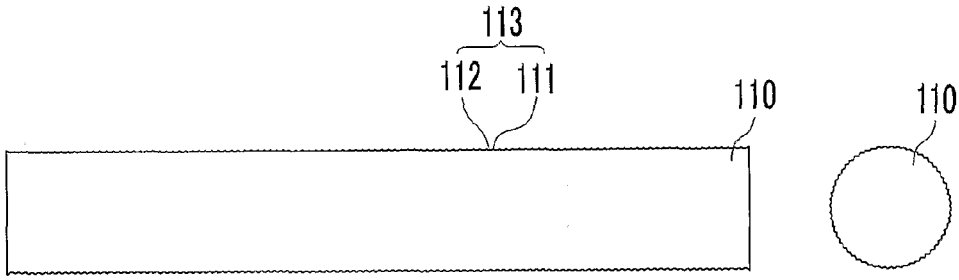
【FIG. 2c】
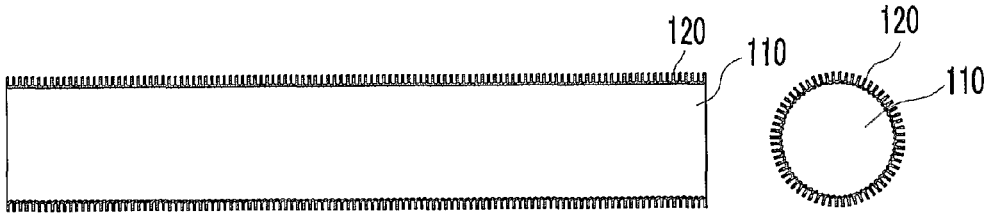

【FIG. 2d】
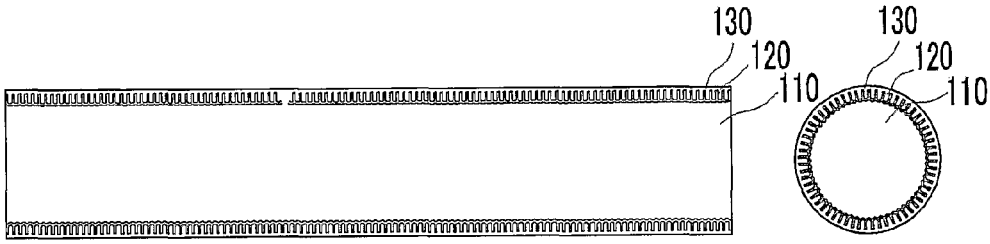
【FIG. 2e】
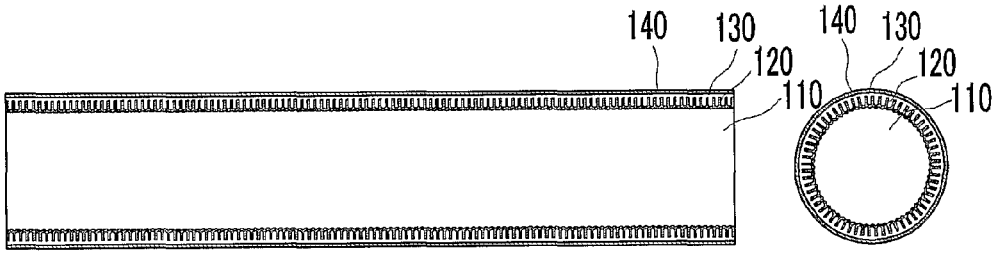
【FIG. 2f】
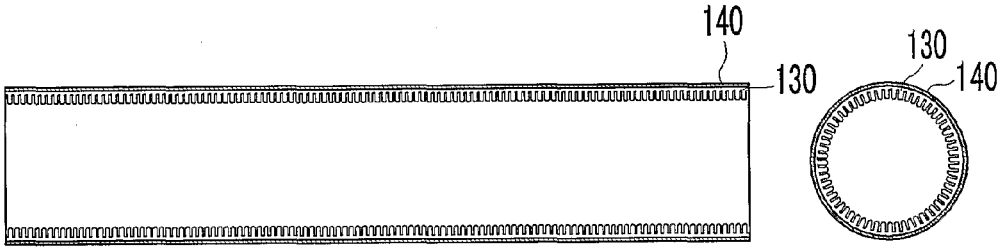

【FIG. 3】
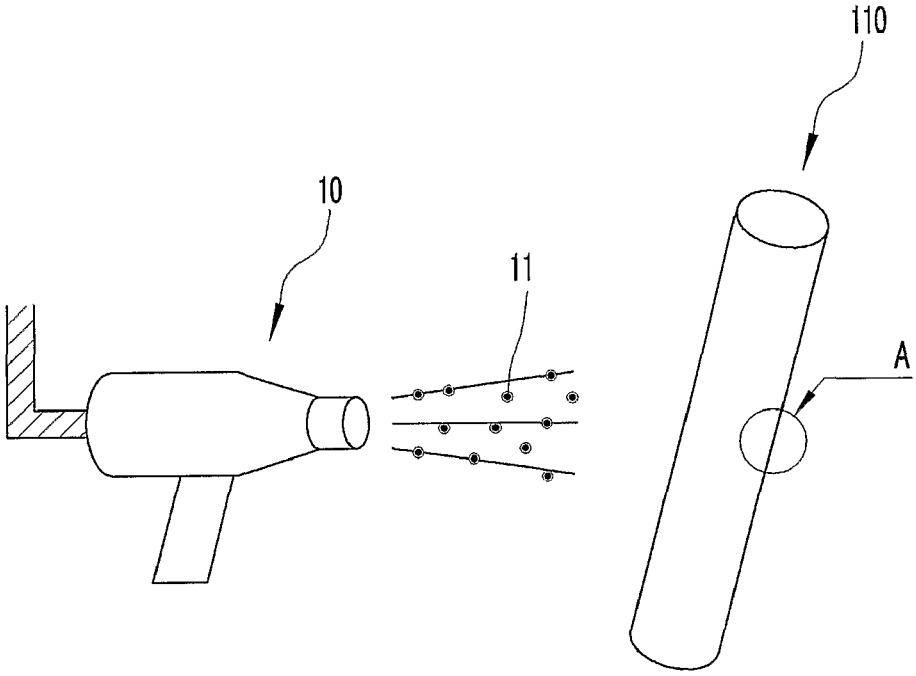
【FIG. 4】
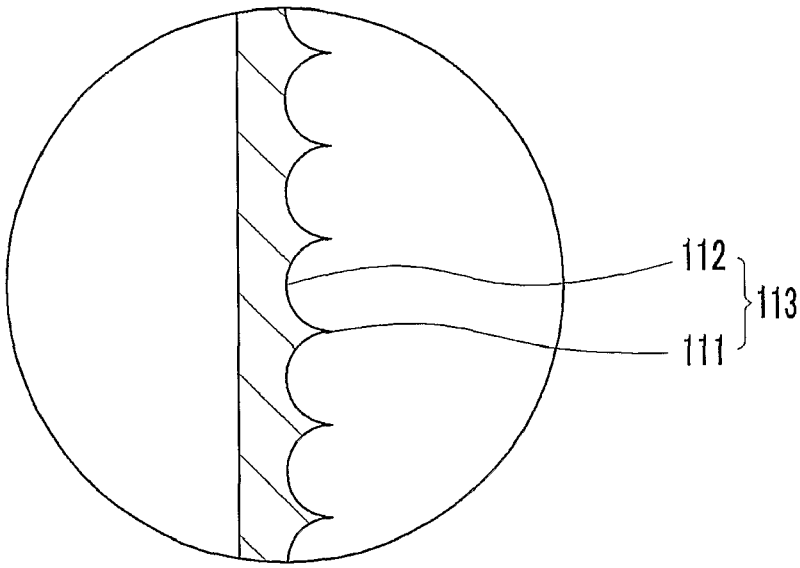

【FIG. 5】
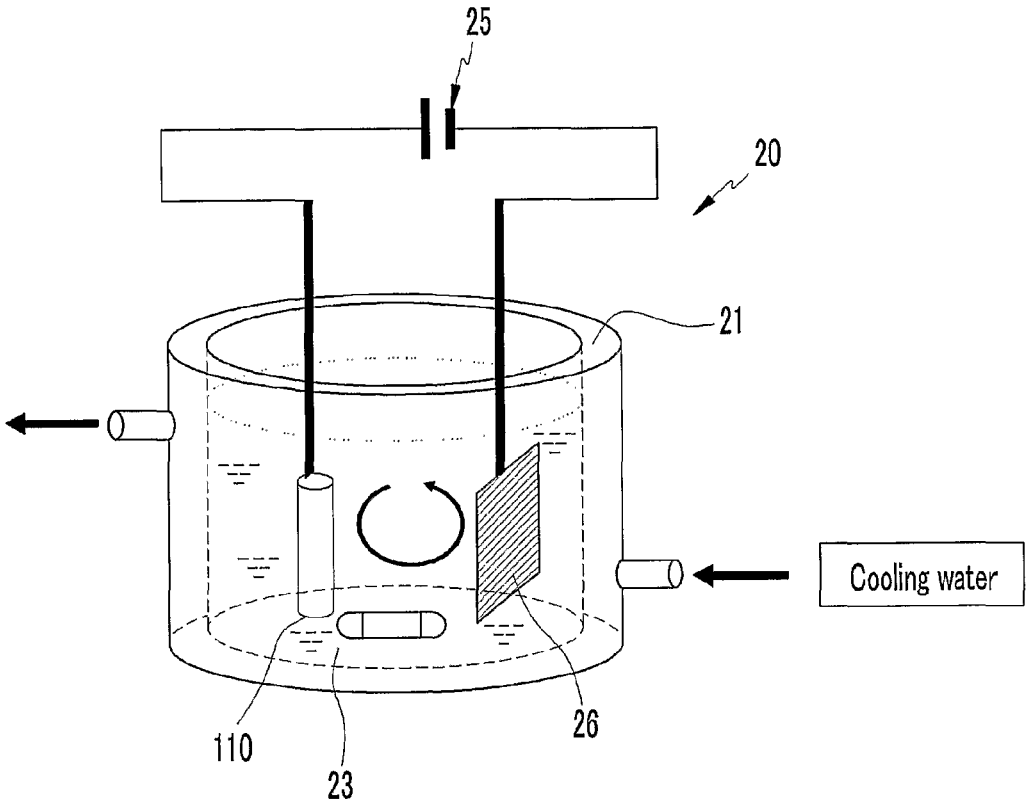

【FIG. 6】
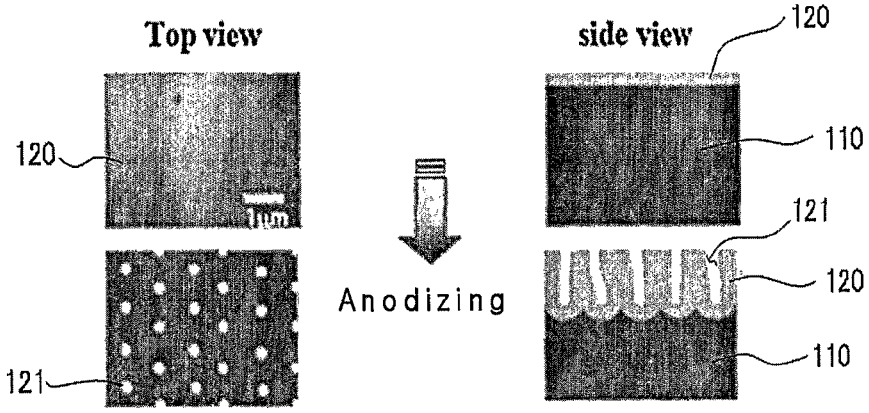
【FIG. 7】
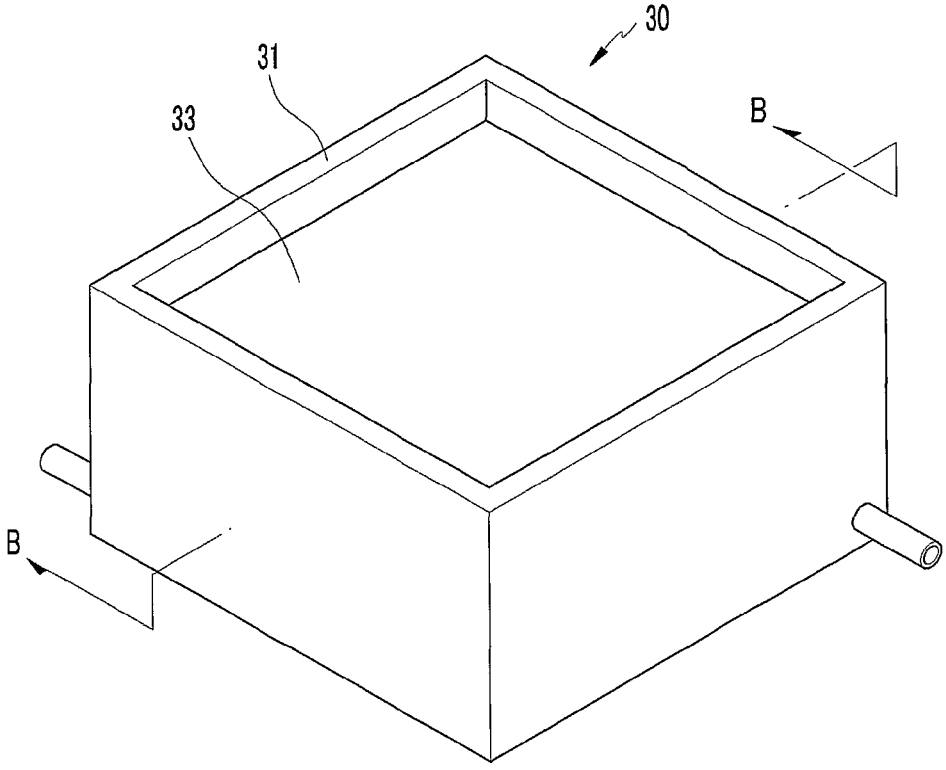

【FIG. 8】
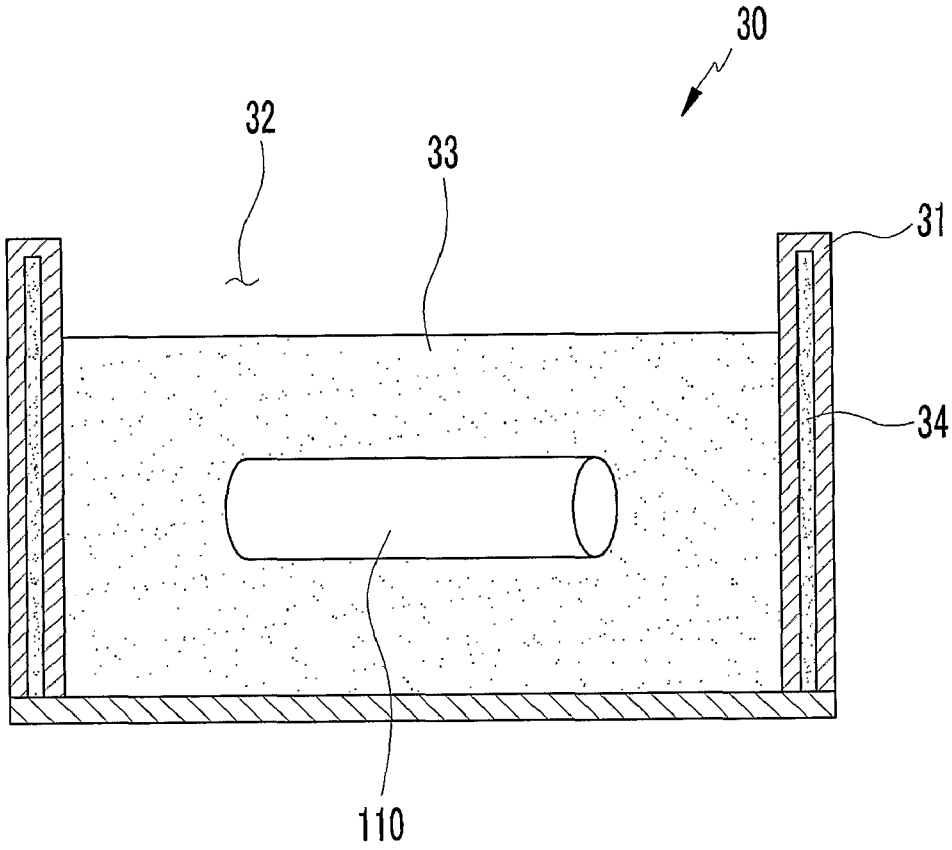

【FIG. 9】
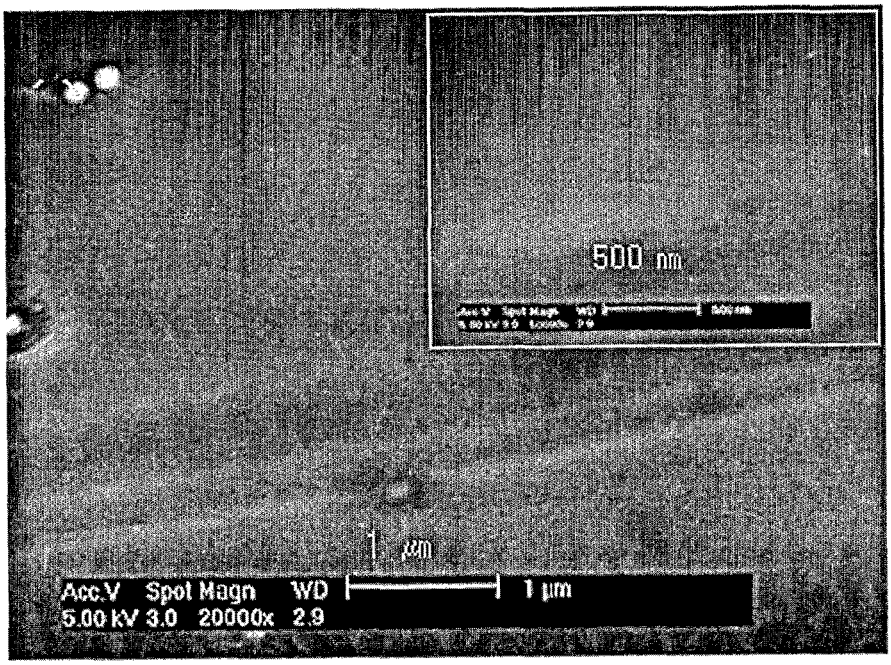
【FIG. 10】
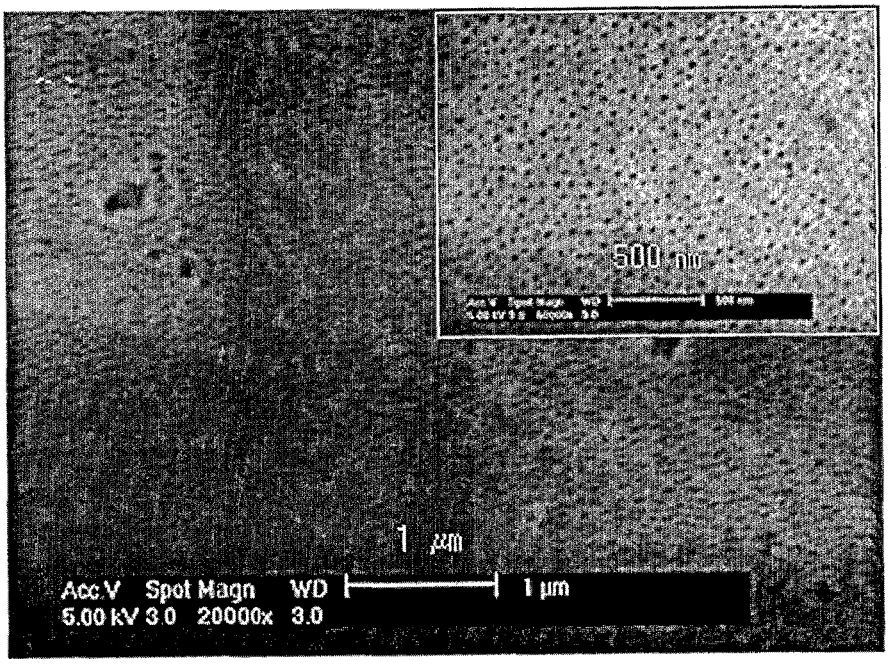

【FIG. 11】
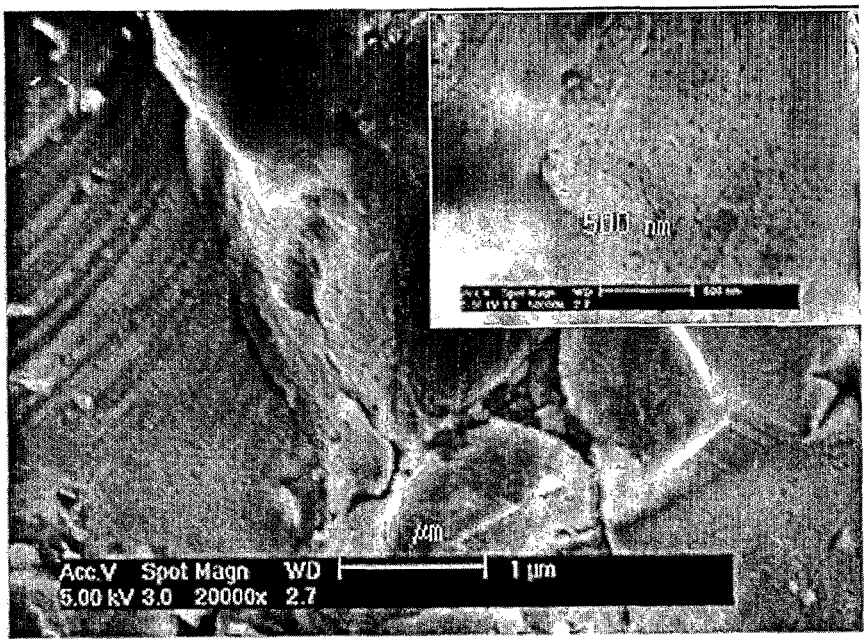
【FIG. 12】
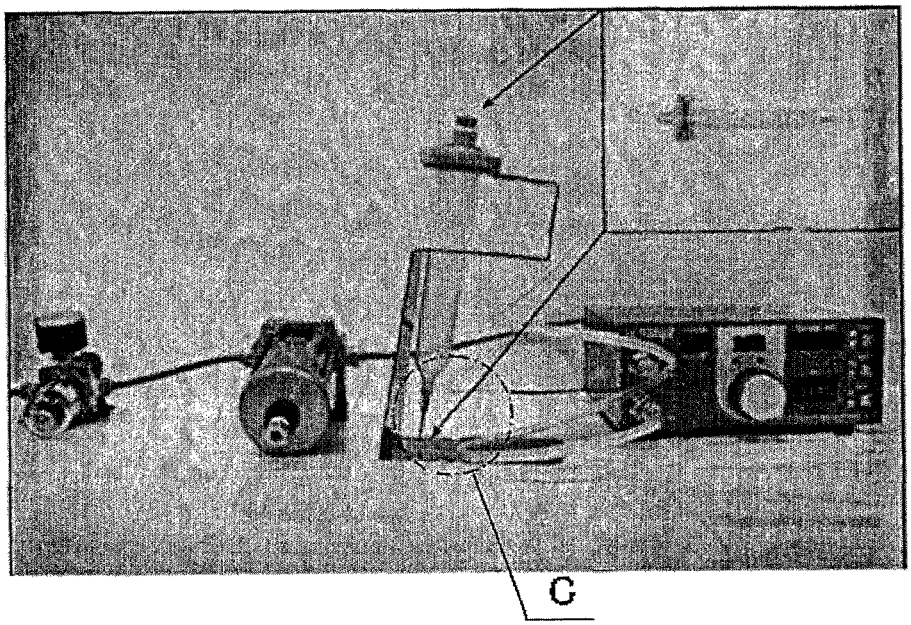

【FIG. 13】
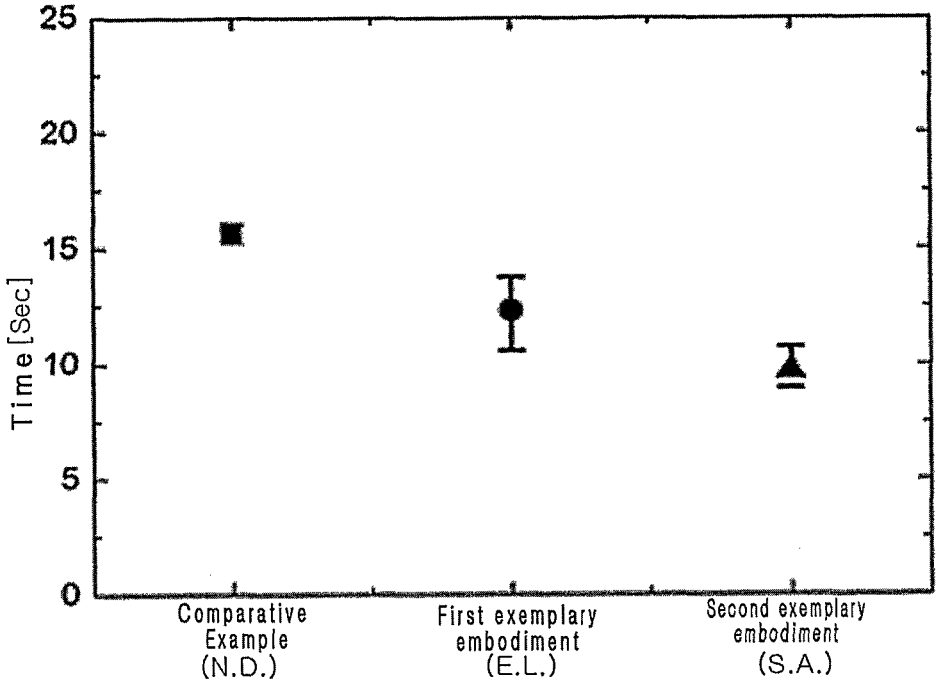
【FIG. 14】
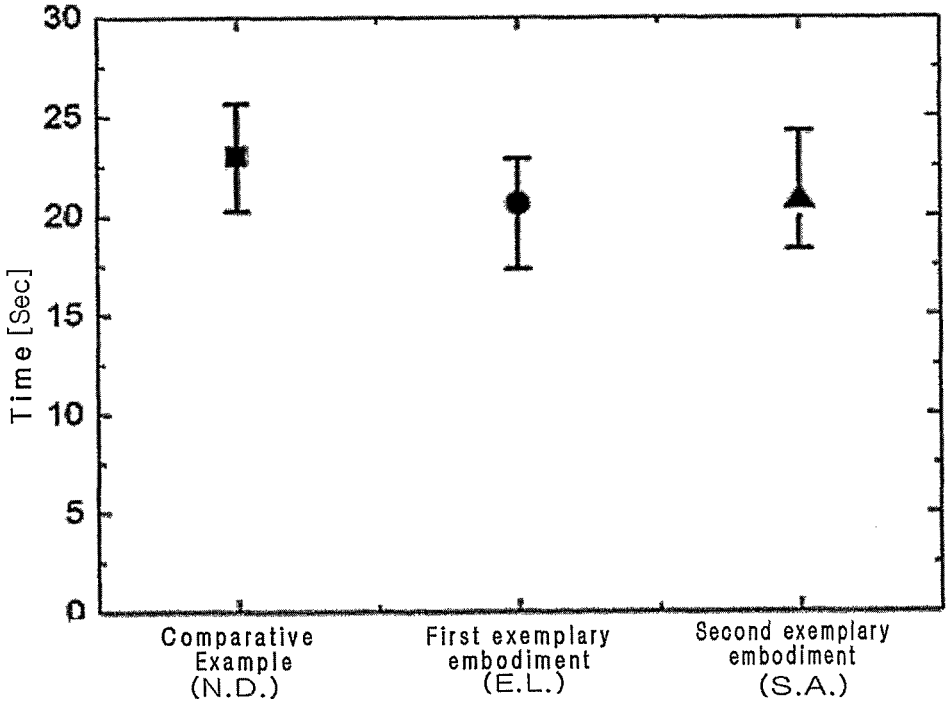

【FIG. 15】
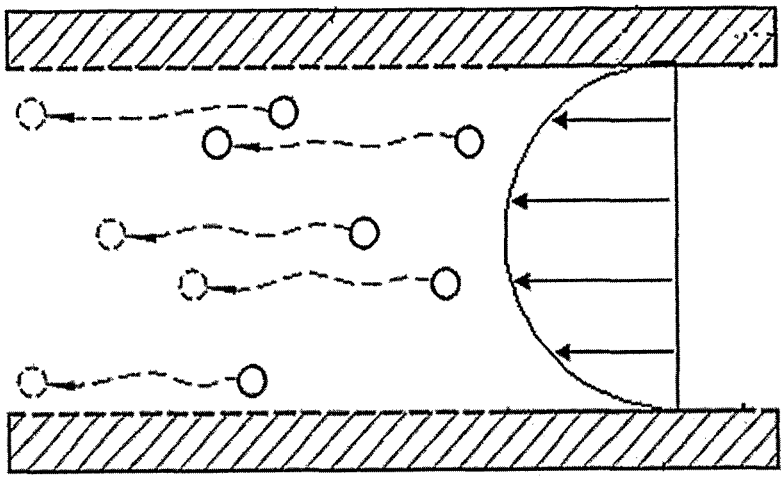
【FIG. 16】
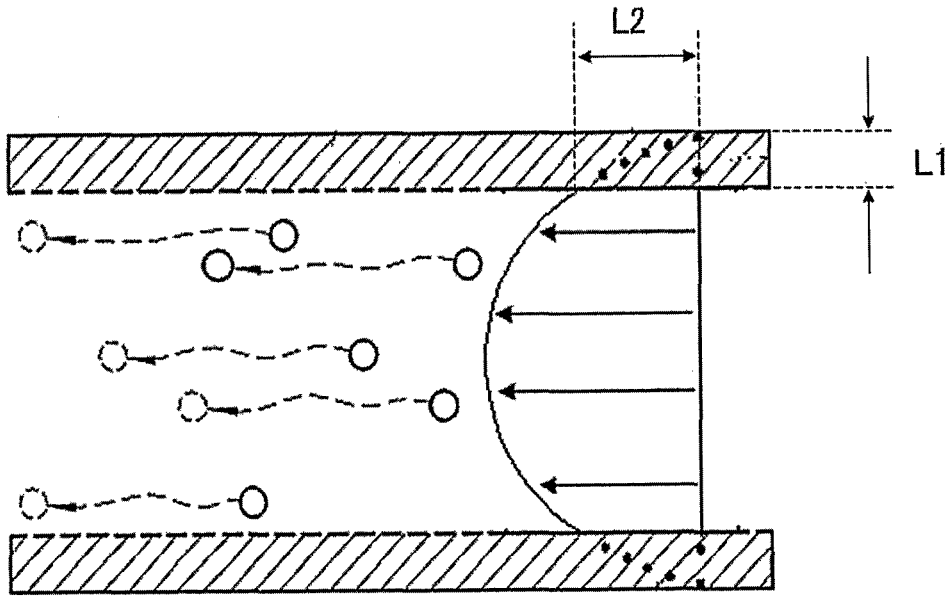

【FIG. 17】
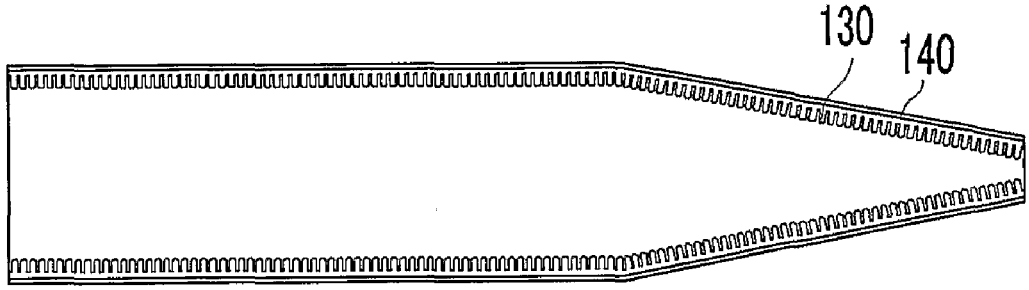

【FIG. 18】
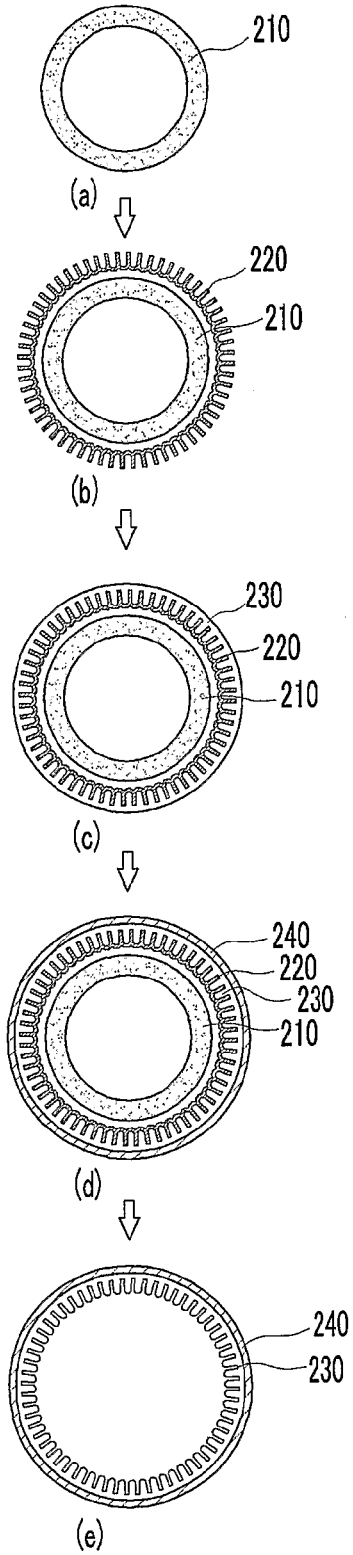

【FIG. 19】
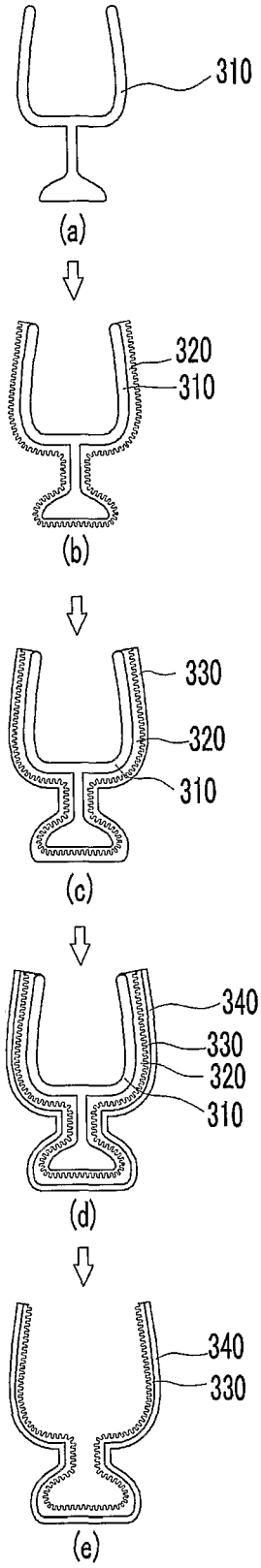

MANUFACTURING METHOD OF 3D SHAPE STRUCTURE HAVING HYDROPHOBIC INNER SURFACE

CROSS-REFERENCE TO RELATED APPLICATION

This application claims priority to and the benefit of Korean Patent Application No. 10-2007-0077497 filed in the Korean Intellectual Property Office on Aug. 1, 2007, the entire contents of which are incorporated herein by reference.

BACKGROUND OF THE INVENTION (a) Field of the Invention

The present invention relates to a manufacturing method of a structure having a hydrophobic inner surface, and more particularly, to a manufacturing method of a three dimensional structure in which a surface treatment process and a replication step are performed to provide hydrophobicity to an inner surface of any three dimensional structure.

(b) Description of the Related Art

Generally, a surface of a solid body formed of a metal or a polymer has an inherent surface energy, which is shown by a contact angle between the solid body and a liquid when the liquid material contacts the solid material. The liquid may include water, oil, and so forth, and hereinafter, water will be exemplified as the liquid. When the contact angle is less than 90°, hydrophilicity, in which a sphere shape of a water drop is dispersed on a surface of the solid body to wet the surface, is shown. In addition, when the contact angle is greater than 90°, hydrophobicity, in which the sphere shape of the water drop is maintained on the surface of the solid body to run on the surface, is shown. As an example of hydrophobicity, a water drop that runs on the surface of a leaf of a lotus flower flows without wetting the leaf.

Further, when the surface of a solid body is processed so as to have slight protrusions and depressions, the contact angle of the surface may vary. That is, when the surface is processed, the hydrophilicity of a hydrophilic surface with a contact angle that is less than 90° may increase, and the hydrophobicity of a hydrophobic surface with a contact angle that is greater than 90° may increase. The hydrophobic surface of the solid body may be variously applied. When the hydrophobic surface is applied to a pipe, the liquid flowing through the pipe may easily slip along the pipe, and therefore the amount and speed of the liquid increases. Accordingly, accumulation of foreign materials may be reduced. In addition, when non-wetting polymer materials are used for the hydrophobic surface, corrosion in a pipe is prevented and water contamination may be reduced.

However, technology for varying the contact angle of the surface of the solid body in response to a specific purpose has depended on a micro electro mechanical system (MEMS) process applying a semiconductor fabrication technology. Therefore, this technology is generally used for a method for forming nano-scale protrusions and depressions on the surface of the solid body. The MEMS process is an advanced mechanical engineering technology applying semiconductor technology. However, the apparatus used for the semiconductor process is very expensive. In order to form the nano-scale protrusions and depressions on a surface of a solid metal body, a variety of processes, which cannot be performed under a normal working environment, such as a process for oxidizing the metal surface, a process for applying a constant temperature and a constant voltage, and a process for oxidizing and etching using a special solution, must be performed.

That is, in order to perform such processes, a specifically designed clean room is required and a variety of expensive apparatuses for performing the processes are necessary. Furthermore, due to a limitation of the semiconductor process, a large surface cannot be processed at once.

As described above, according to the conventional technology for forming the hydrophobic surface, the process is very complicated and it is difficult to mass-produce products. Furthermore, the cost for producing the products is very high. Therefore, it is difficult to apply the conventional technology.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a manufacturing method for performing a surface treatment process including a fine particle spraying step and an anodizing step and a replication step of a non-wetting polymer material to form a structure having a hydrophobic inner surface with a reduced cost and a simplified process.

In addition, the present invention has been made in an effort to provide a manufacturing method for providing hydrophobicity to an inner surface of any shape of three dimensional structures.

According to an exemplary embodiment of the present invention, a manufacturing method of a three dimensional structure having a hydrophobic inner surface includes an anodizing, forming a replica, forming an exterior, and etching. In the anodizing step, a three dimensional metal member is anodized and fine holes are formed on an external surface of the metal member. In the replication step, a non-wetting polymer material is coated on the outer surface of the metal member and the non-wetting polymer material is formed to be a replication structure corresponding to the fine holes of the metal member. In the exterior formation step, the replication structure is surrounded with an exterior forming material. In the etching step, the metal member is etched and the metal member is eliminated from the replication structure and the exterior forming material.

The exterior forming material has adhesion on its surface contacting the replication structure, and has flexibility so as to be adhered on a curved external surface of the replication structure. The exterior forming material is an acryl film.

The manufacturing method further includes a particle spraying step for spraying fine particles and forming fine protrusions and depressions on the external surface of the metal member, before the anodizing step.

In the particle spraying step, the metal member is formed in a cylindrical shape, and the fine particles are sprayed on a circumferential surface of the metal member. The exterior forming material is adhered on an area corresponding to the circumferential surface of the metal member.

In the replication step, the non-wetting polymer material is provided in the fine holes of the metal member, and the replication structure has a plurality of columns corresponding to the fine holes.

In the replication step, the plurality of columns partially stick to each other to form a plurality of groups.

In the etching step, the metal member is wet-etched.

The metal member is formed of an aluminum material.

BRIEF DESCRIPTION OF THE DRAWINGS

FIG. 1 is a flowchart representing a manufacturing method of a three-dimensional structure having a hydrophobic inner surface according to an exemplary embodiment of the present invention.

FIG. 2A is a schematic diagram of a metal member used in the exemplary embodiment of the present invention.

FIG. 2B is a schematic diagram representing fine protrusions and depressions formed on an external surface of the metal member shown in FIG. 2A.

FIG. 2C is a schematic diagram representing an anode oxide layer formed on the external surface of the metal member shown in FIG. 2B.

FIG. 2D is a schematic diagram representing a replication structure corresponding to the external surface of the metal member shown in FIG. 2C.

FIG. 2E is a schematic diagram representing an exterior forming material formed on an external surface of the replication structure shown in FIG. 2D.

FIG. 2F is a schematic diagram representing the replication structure and an exterior forming material formed by eliminating the metal member and the anode oxide layer shown in FIG. 2E by an etching step.

FIG. 3 is a schematic diagram of a particle spraying unit for forming fine protrusions and depressions in the metal member shown in FIG. 2A.

FIG. 4 is an enlarged diagram of area A shown in FIG. 3 to show the fine protrusions and depressions formed on the surface of the metal member.

FIG. 5 is a schematic diagram representing an anodizing device for anodizing the metal member shown in FIG. 2B.

FIG. 6 is a diagram representing fine holes on a surface of the fine protrusions and depressions after anodizing the metal member shown in FIG. 5.

FIG. 7 is a schematic diagram of a replication device for replicating a cathode shape corresponding to the surface of the metal member shown in FIG. 2C.

FIG. 8 is a cross-sectional view of a replication device along line B-B shown in FIG. 7.

FIG. 9 is a microscope picture of a pipe structure manufactured without any inner surface treatment process according to a comparative example of the present invention.

FIG. 10 is a microscope picture of a pipe structure manufactured by an anodizing step according to a first exemplary embodiment of the present invention.

FIG. 11 is a microscope picture of a pipe structure manufactured by a particle spraying step and the anodizing step according to a second exemplary embodiment of the present invention.

FIG. 12 is a picture of a flow performance experimenting device for conducting experiments on the flow performance of the pipe structures shown in FIG. 9 to FIG. 11.

FIG. 13 is a flow performance experiment result graph using water as an operational liquid in the flow performance experimenting device shown in FIG. 12.

FIG. 14 is a flow performance experiment result graph using a cleansing agent as the operational liquid in the flow performance experimenting device shown in FIG. 12.

FIG. 15 is a cross-sectional view representing liquid flow speeds in the pipe structure formed without an inner surface treatment process according to the comparative example of the present invention.

FIG. 16 is a cross-sectional view representing liquid flow speeds in the pipe structure having the hydrophobic inner surface according to the first exemplary embodiment of the present invention or the second exemplary embodiment of the present invention.

FIG. 17 is a cross-sectional view of a tapered pipe structure according to the exemplary embodiments of the present invention.

FIG. 18 shows cross-sectional views representing respective manufacturing processes by using a tube-shaped metal member according to the exemplary embodiment of the present invention.

FIG. 19 shows cross-sectional views representing respective manufacturing processes by using a three dimensional shape product according to the exemplary embodiment of the present invention.

DETAILED DESCRIPTION OF THE EMBODIMENTS

In the following detailed description, only certain exemplary embodiments of the present invention have been shown and described, simply by way of illustration. As those skilled in the art would realize, the described embodiments may be modified in various different ways, all without departing from the spirit or scope of the present invention.

FIG. 1 is a flowchart representing a manufacturing method of a three-dimensional structure having a hydrophobic inner surface according to an exemplary embodiment of the present invention.

As shown in FIG. 1, since a small particle spraying step S1, an anodizing step S2, a replication step S3, an exterior formation step S4, and a metal member etching step S5 are performed in the manufacturing method of the structure having the hydrophobic inner surface according to the exemplary embodiment of the present invention, the structure having the hydrophobic inner surface may be simply manufactured with a reduced cost compared to a conventional micro electro mechanical system (MEMS) process. Further, in the manufacturing method according to the exemplary embodiment of the present invention, hydrophobicity may be realized in an inner surface of any three-dimensional structure.

FIG. 2A to FIG. 2F respectively show schematic diagrams representing manufacturing processes of a pipe structure according to the manufacturing method of the structure having the hydrophobic inner surface according to the exemplary embodiment of the present invention, and FIG. 2A shows a metal member used in the exemplary embodiment of the present invention.

As shown in FIG. 2A, a metal member 110 according to the exemplary embodiment of the present invention is a cylindrical-shaped aluminum sample having a diameter of 2 mm and a length of 70 mm, and it is used to realize the hydrophobicity on an inner surface of the pipe structure. In a preliminary process of the manufacturing method according to the exemplary embodiment of the present exemplary embodiment, the metal member 110 is immersed in a solution obtained by combining perchloric acid and ethanol in a volume ratio of 1:4, electropolishing is performed, and a surface of the metal member 110 is planarized.

FIG. 3 is a schematic diagram of a particle spraying unit for forming fine protrusions and depressions in the metal member shown in FIG. 2A.

FIG. 1, FIG. 2B, and FIG. 3 show the small particle spraying step S1 for spraying small particles 11 to form fine protrusions and depressions 113 on an external surface of the metal member 110 according to the exemplary embodiment of the present invention. A particle spraying unit 10 is used to perform the small particle spraying step S1 in the exemplary embodiment of the present invention. The particle spraying unit 10 collides the small particles 11 against a surface of the metal member 110 with a predetermined speed and a predetermined pressure. Thereby, the metal member 110 is transformed by impact energy of the small particles 11, and the fine protrusions and depressions 113 are formed on the external surface thereof. Particularly, in the exemplary embodiment of the present invention, since the small particles 11 are concentrated on a circumferential surface of the metal member 110 and the metal member 110 is rotated while spraying the small particles 11, the fine protrusions and depressions 113 may be uniformly formed on the circumferential surface of the metal member 110. A sand blaster for spraying sand particles is used as the particle spraying unit 10 according to the exemplary embodiment of the present invention to spray small particles such as metal balls rather than sand particles. Micro-scale protrusions and depressions are formed on the external surface of the metal member 110 by driving the particle spraying unit 10.

FIG. 4 is an enlarged diagram of area A shown in FIG. 3 to show the fine protrusions and depressions formed on the surface of the metal member 110.

As shown in FIG. 3 and FIG. 4, a scale of the fine protrusions and depressions 113 of the metal member 110 is determined by the depth of depressions 111, and the height of protrusions 112, or the distance between the protrusions 112. The scale of the fine protrusions and depressions 113 may vary according to a spray speed and a spray pressure of the particle spraying unit 10, and a size of the fine particles 11, which may be adjusted by predetermined values Except for superhydrophobic materials, a solid material such as a metal or a polymer is generally a hydrophilic material having a contact angle that is less than 90°. When a surface of the hydrophilic material is processed to have the fine protrusions and depressions 113 by the surface treatment processing method according to the exemplary embodiment of the present invention, the contact angle is decreased and the hydrophilicity increases.

FIG. 5 is a schematic diagram representing an anodizing device for anodizing the metal member shown in FIG. 2B.

As shown in FIG. 1, FIG. 2C, FIG. 4, and FIG. 5, the anodizing step S2 for anodizing the metal member 110 to form fine holes on the external surface of the metal member 110 is performed. When the metal member 110 is immersed in an electrolyte solution 23 and an electrode is applied in the anodizing step, an anode oxide layer 120 is formed on the surface of the metal member 110. Accordingly, in the anodizing step, nanometer-scale fine holes that are finer than the fine protrusions and depressions 113 formed on the external surface of the metal member 110 may be formed.

An anodizing device 20 shown in FIG. 5 is used to perform the anodizing step in the exemplary embodiment of the present invention. An electrolyte solution 23 (e.g., 0.3M oxalic acid $C_2H_2O_4$ or phosphoric acid) is provided in an inner storage space of a main body 21 of the anodizing device 20, and the metal member 110 is immersed in the electrolyte solution 23. The anodizing device 20 includes a power supply unit 25, the metal member 110 is connected to one of an anode electrode and a cathode electrode of the power supply unit 25, and a metal member 26 of a platinum material is connected to the other electrode of the power supply unit 25. Here, any material may be used for the metal member 26 if the material is a conductor to which a power source may be applied. While the metal member 110 and the metal member 26 are maintained at a predetermined distance (e.g., 50 mm), the power supply unit 25 applies a predetermined constant voltage (e.g., 60V). In this case, the electrolyte solution 23 is maintained at a predetermined temperature (e.g., 15° C.), and a stirrer is used to stir the solution so as to prevent deflection of solution concentration. Thereby, alumina as the anode oxide layer 120 is formed on the external surface of the metal member 110. The metal member 110 is removed from the electrolyte solution 23 after the anodizing step, the metal member is washed in deionized water for a predetermined time (e.g., approximately 15 minutes), and it is dried in an oven of a predetermined temperature (e.g., 60° C.) for a predetermined time (e.g., approximately one hour).

Thereby, not only the fine protrusions and depressions 113 are formed on the metal member 110 in the small particle spraying step S1, but also the nanometer-scale fine holes 121 that are finer than the fine protrusions and depressions 113 are formed on the anode oxide layer 120 in the anodizing step S2 as shown in FIG. 6.

FIG. 7 is a schematic diagram of a replication device for duplicating a cathode shape corresponding to the surface of the metal member shown in FIG. 2C, and FIG. 8 is a cross-sectional view of a replication device along a line B-B shown in FIG. 7.

As shown in FIG. 1, FIG. 2D, FIG. 7, and FIG. 8, the replication step S3 for coating a non-wetting polymer material on the external surface of the metal member 110 to form the non-wetting polymer material to be a replication structure 130 corresponding to the fine holes of the metal member 110 is performed. In the replication step S3, the metal member 110 having the micro-scale fine protrusions and depressions 113 and the nano-scale fine holes 121 on the external surface thereof by the particle spraying step S1 and the anodizing step S2 is provided.

The replication device 30 shown in FIG. 7 and FIG. 8 is used to perform the replication step S3. The replication device 30 includes a body 31, a storage portion 32 having a predetermined storage space in the body 31, a non-wetting polymer solution 33 provided in the storage portion 32, and a cooling unit 34 provided on side surfaces of the body 31 to solidify the non-wetting polymer solution 33 in the storage portion 32.

In the replication device 30, the metal member 110 is immersed as a replication frame in the non-wetting polymer solution 33, and the non-wetting polymer material is coated on the external surface of the metal member 110. That is, the non-wetting polymer solution 33 is provided into the fine holes 121 of the metal member 110, and the non-wetting polymer material around the metal member 110 is solidified by the cooling unit 34 of the replication device 30. As described, in the exemplary embodiment of the present invention, since the non-wetting polymer material is coated on the external surface of the metal member 110, the non-wetting polymer material forms the replication structure 130 having a cathode shape surface corresponding to a shape of the fine holes 121. That is, the replication structure 130 has a column shape since it has a cathode shape surface corresponding to the fine holes 121, and the replication structure 130 has a plurality of columns respectively corresponding to the fine holes 121.

The non-wetting polymer solution 33 is formed of at least one material among polytetrafluorethylene (PTFE), fluorinated ethylene propylene copolymer (FEP), and perfluoroalkoxy (PFA).

Subsequently, as shown in FIG. 2E, the exterior formation step S4 for surrounding an external surface of the replication structure 130 with an exterior forming material 140 is performed. The exterior forming material 140 has adhesion, and it has flexibility so as to be adhered on the curved external surface of the replication structure 130. Particularly, in the exemplary embodiment of the present invention, since the manufacturing method of the pipe structure having the hydrophobic inner surface is exemplified, an acryl film used as a pipe material is surrounded around a circumferential surface of the cylindrical shape metal member 110. In the exemplary embodiment of the present invention, various materials may be used as the exterior forming material 140.

Subsequently, the etching step S5 for etching the metal member 110 including the anode oxide layer 120 to eliminate the metal member 110 including the anode oxide layer 120 to form the replication structure 130 and the exterior forming material 140 is performed. The metal member 110 including the anode oxide layer 120 may be appropriately etched by a wet-etching process in the etching step S5. Accordingly, as shown in FIG. 2F, the replication structure 130 and the exterior forming material 140 remain. As described, since the replication structure 130 includes the plurality of fine columns on the inner surface thereof, the replication structure 130 may have the hydrophobic surface having the micro scale and the nano scale. That is, since the inner surface of the replication structure 130 is formed in a section that is the same as that of a leaf of a lotus flower, the hydrophobicity of minimized hydrophilicity is provided, and therefore a contact angle with a liquid is considerably increased to be greater than 160°.

In addition, as an aspect ratio (a ratio of length to diameter) increases (e.g., the aspect ratio is within a range of 100 to 1900), the plurality of columns partially stick to each other to form a plurality of groups, and micro-scale flections may be formed. Accordingly, since the replication structure 130 includes the micro-scale flections and nano-scale columns, it may have a superhydrophobic inner surface.

In the exemplary embodiment of the present invention, the particle spraying step S1 may be omitted and the anodizing step S2 may be performed on the surface of the metal member. In this case, an aspect ratio of the fine holes formed by the anodizing step is increased (e.g., within a range of 100 to 1900), the nano-scale columns duplicated by the fine holes stick together to form a plurality of groups, and the micro-scale flections may be formed. Accordingly, in the exemplary embodiment of the present invention, even when the particle spraying step S1 is omitted, a three-dimensional structure having the hydrophobic inner surface may still be manufactured.

Experimental Example

Experiments on pipe structures according to a first exemplary embodiment, a second exemplary embodiment, and a comparative example will be conducted with the same flow conditions to compare the hydrophobicities of the inner surfaces. The particle spraying step is omitted and the metal member is anodized to manufacture the pipe structure in the first exemplary embodiment, the particle spraying step and the anodizing step are performed to manufacture the pipe structure in the second exemplary embodiment, and the pipe structure according to the comparative example is manufactured without any inner surface treatment process.

An aluminum sample having a diameter of 2 mm and a length of 7 cm is used as the metal member. The metal member is electropolished in a solution obtained by combing perchloric acid and ethanol in a volume ratio of 1:4. In addition, a sand blaster is used in the particle spraying step to spray sand particles of average 500 mesh (28 μm) to the metal member, and the metal member is immersed in a solution of 0.3M oxalic acid to perform the anodizing step. In this case, platinum is used as a counter electrode in a cathode electrode of the anodizing device, and a distance between the counter electrode and the metal member in an anode electrode is maintained to be 50 mm. The anodizing device supplies a constant voltage of 60V to the two electrodes, and the electrolyte solution is agitated whilst being maintained at a predetermined temperature of 15° C. After the anodizing treatment is performed, the metal member is removed from the electrolyte solution to wash it with deionized water for 15 minutes, and then the metal member is dried in an oven of 60° C. for one hour. In the replication step, the metal member, which is a frame for replication, is immersed in a non-wetting polymer solution in which 6% PTFE (DuPont Teflon® AF: Amorphous Fluoropolymer Solution) and a solvent (ACROS FC-75) are combined, and it is cured at room temperature. Thereby, the solvent is evaporated while being cured, and a thin non-wetting polymer material of PTFE remains. An acryl film is used in the exterior formation step.

FIG. 9 is a microscope picture of the pipe structure manufactured without any inner surface treatment process according to the comparative example of the present invention. The surface of the metal member is planarized and the replication step and the etching step are performed to form the pipe structure according to the comparative example without the particle spraying step and the anodizing step in the manufacturing method according to the exemplary embodiment of the present invention. Thereby, since a contact angle with a liquid is reduced in the pipe structure according to the comparative example as shown in FIG. 9, it is difficult to obtain the hydrophobicity.

FIG. 10 is a microscope picture of the pipe structure manufactured by the anodizing step according to the first exemplary embodiment of the present invention. The pipe structure according to the first exemplary embodiment of the present invention is manufactured by omitting the particle spraying step and performing the replication step and the etching step after the metal member is anodized. Thereby, the pipe structure according to the first exemplary embodiment of the present invention has a hydrophobic surface including a plurality of columns as shown in FIG. 10.

FIG. 11 is a microscope picture of the pipe structure manufactured by the particle spraying step and the anodizing step according to the second exemplary embodiment of the present invention. The particle spraying step and the anodizing step are performed to manufacture the pipe structure according to the second exemplary embodiment of the present invention. Thereby, the pipe structure according to the second exemplary embodiment of the present invention has a super-hydrophobic surface including micro-scale protrusions and depressions and nano-scale columns as shown in FIG. 11.

FIG. 12 is a picture of a flow performance experimenting device for conducting experiments on the flow performance of the pipe structures shown in FIG. 9 to FIG. 11.

The pipe structures respectively shown in FIG. 9 to FIG. 11 are provided at an end area C of a syringe through which a liquid is output, and flow performance experiments are conducted using the flow performance experimenting device shown in FIG. 12. In this case, a model ML-500XII of Musashi Engineering, Inc. is used as the flow performance experimenting device to measure weights of liquids output from the pipe structures for 30 seconds and to compare the weights. Since the amount of liquid flowing through the pipe increases as the amount of output liquid increases, liquid transferring times of the respective pipes may be compared.

FIG. 13 is a flow performance experiment result graph using water as an operational liquid in the flow performance experimenting device shown in FIG. 12, and output pressure of the water is set to be 6 kPa. Since liquid transferring times of the pipe structures according to the first and second exemplary embodiments of the present invention are shorter than that of the comparative example, the flow performance of the pipe structures according to the first and second exemplary embodiments of the present invention is higher than that of the comparative example. Further, since the liquid transferring time of the pipe structure according to the second exemplary embodiment of the present invention is shorter than that of the first exemplary embodiment of the present invention in which the particle spraying step is not performed, the flow performance of the pipe structure according to the second exemplary embodiment of the present invention is higher than that of the first exemplary embodiment of the present invention.

FIG. 14 is a flow performance experiment result graph using a cleansing agent as the operational liquid in the flow performance experimenting device shown in FIG. 12, and output pressure of the cleansing agent is set to be 35 kPa. The liquid transferring times of the pipe structures according to the first and second exemplary embodiments of the present invention are shorter than that of the comparative example, and therefore the flow performance is higher. However, flow performance differences are low since the cleansing agent has lower liquid viscosity compared to water, but the flow performance in the first and second exemplary embodiments of the present invention is higher than that of the comparative example.

As shown in the experiment results shown in FIG. 13 and FIG. 14, since the pipe structures according to the first and second exemplary embodiments of the present invention have hydrophobicity on the inner surface, the flow performance is increased to be higher than that of the comparative example in which the hydrophobicity is not provided.

FIG. 15 is a cross-sectional view representing liquid flow speeds in the pipe structure formed without an inner surface treatment process according to the comparative example of the present invention, and FIG. 16 is a cross-sectional view representing liquid flow speeds in the pipe structure having the hydrophobic inner surface according to the first exemplary embodiment of the present invention or the second exemplary embodiment of the present invention.

A sheering stress is close to 0 at an inner center of the pipe structure shown in FIG. 15, and the sheering stress is maximized on the inner surface of the pipe. Therefore, a liquid flow speed in the pipe structure shown in FIG. 15 is maximized at an inner center of the pipe, and it is reduced to be close to 0 on the inner surface of the pipe.

However, since the hydrophobicity is provided on the surface of the pipe structure shown in FIG. 16, friction with the liquid on the inner surface is reduced and the sheering stress on the inner surface is reduced to be lower than that of the pipe structure shown in FIG. 15. That is, the sheering stress on the inner surface is reduced in the pipe structure shown in FIG. 16, and therefore a liquid flow speed distribution length L2 is increased to be longer than a slip length L1. As described, the flow performance of the pipe structure shown in FIG. 16 may be improved compared to the pipe structure shown in FIG. 15.

In the exemplary embodiments of the present invention, the metal member 110 of the cylindrical shape is used to describe the manufacturing method in which the hydrophobicity is provided to the inner surface of the pipe structure having a section. In addition, in the exemplary embodiments of the present invention, a shape of the metal member 110 that is a frame for replication is changed, the exterior forming material 140 is adhered, and therefore a tapered pipe structure (refer to FIG. 17) may be applied.

In addition, in the exemplary embodiments of the present invention, as shown in FIG. 18, a tube-shaped metal member 210 having a hollow space section may be used. That is, an anode oxide layer 220 and a replication structure 230 are sequentially formed on an outer surface of the tube-shaped metal member 210 according to the exemplary embodiment of the present invention, and an exterior forming material 240 is surrounded around the replication structure 230. In addition, in the exemplary embodiment of the present invention, since the metal member 210 and the anode oxide layer 220 are etched, the hydrophobicity may be provided to an inner surface of a can for storing beverages. In this case, in the exemplary embodiment of the present invention, it is required to fill a predetermined material in an inner space of the tube-shaped metal member 210 in a manufacturing process to prevent a shape variation.

In the exemplary embodiment of the present invention, the same manufacturing processes are performed for a metal member 310 shown in FIG. 9. That is, an anode oxide layer 320 and a replication structure 330 are sequentially formed on an external surface of the metal member 310, and an exterior forming material 340 is surrounded on an external surface of the replication structure 330. In addition, the metal member 310 and the anode oxide layer 320 are etched, and therefore the hydrophobicity may be provided to various shaped three dimensional inner surfaces.

As described, in the manufacturing method of the three dimensional shape structure having the hydrophobic inner surface according to the exemplary embodiment of the present invention, the hydrophobicity may be provided to the inner surface, a high cost device required in the conventional MEMS process is not used, a manufacturing cost is reduced, and a manufacturing process is simplified.

Further, since a shape of the metal member that is a frame for replication is changed and an exterior forming material is adhered, the hydrophobicity may be provided to inner surfaces of a tapered pipe structure, a can for storing beverages, and a complicated three dimensional product.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A manufacturing method of a three dimensional structure having a hydrophobic inner surface, comprising:

anodizing a three dimensional metal member and forming fine holes on an external surface of the metal member;

forming a replica by coating a non-wetting polymer material on the outer surface of the metal member and forming the non-wetting polymer material to be a replication structure corresponding to the fine holes of the metal member;

forming an exterior by surrounding the replication structure with an exterior forming material, wherein the exterior forming material is different from the non-wetting polymer material; and etching the metal member and eliminating the metal member from the replication structure and the exterior forming material to form a hollow structure.

2. The manufacturing method of claim 1, wherein the exterior forming material has adhesion on its surface contacting the replication structure.

3. The manufacturing method of claim 1, wherein the exterior forming material has flexibility so as to be adhered on a curved external surface of the replication structure.

4. The manufacturing method of claim 2, wherein the exterior forming material is an acryl film.

5. The manufacturing method of claim 1, further comprising, before anodizing, spraying fine particles and forming fine protrusions and depressions on the external surface of the metal member.

6. The manufacturing method of claim 5, wherein the metal member is formed in a cylindrical shape, and the fine particles are sprayed on a circumferential surface of the metal member.

7. The manufacturing method of claim 6, wherein the exterior forming material is adhered on an area corresponding to the circumferential surface of the metal member.

8. The manufacturing method of claim 1, wherein the non-wetting polymer material is provided in the fine holes of the metal member, and the replication structure has a plurality of columns corresponding to the fine holes.

9. The manufacturing method of claim 8, wherein the plurality of columns partially stick to each other to form a plurality of groups.

10. The manufacturing method of claim 1, wherein the metal member is wet-etched.

11. The manufacturing method of claim 1, wherein the metal member is formed of an aluminum material.

* * * * *